US006520079B1

(12) United States Patent
Holm

(10) Patent No.: US 6,520,079 B1
(45) Date of Patent: Feb. 18, 2003

(54) RUBBER BLANKET AND DEVICE FOR FIXING A RUBBER BLANKET

(75) Inventor: Helmut Holm, Erlabrunn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/857,219

(22) PCT Filed: Dec. 21, 1999

(86) PCT No.: PCT/DE99/04048

§ 371 (c)(1),
(2), (4) Date: Jun. 20, 2001

(87) PCT Pub. No.: WO00/38921

PCT Pub. Date: Jul. 6, 2000

(30) Foreign Application Priority Data

Dec. 28, 1998 (DE) ..... 198 60 477

(51) Int. Cl.[7] ..... B41F 5/00; B41F 17/00; B41F 1/28; B41L 47/46

(52) U.S. Cl. ..... 101/216; 101/36; 101/37; 101/91; 101/220; 101/415.1

(58) Field of Search ..... 101/415.1, 36, 101/91, 37, 220, 216

(56) References Cited

U.S. PATENT DOCUMENTS

| | | | | |
|---|---|---|---|---|
| 4,421,024 A | * | 12/1983 | Burger et al. | 101/415.1 |
| 4,742,769 A | * | 5/1988 | Zeller | 101/216 |
| 4,833,984 A | * | 5/1989 | Bolza-Schunemann et al. | 101/220 |
| 4,833,986 A | * | 5/1989 | Kobler | 101/415.1 |
| 5,329,853 A | | 7/1994 | Stegmeir | |
| 5,809,889 A | * | 9/1998 | Holm | 101/415.1 |
| 6,019,043 A | * | 2/2000 | Knauer et al. | 101/415.1 |

FOREIGN PATENT DOCUMENTS

| | | |
|---|---|---|
| DE | 78 20 773 U1 | 11/1978 |
| DE | 42 10 778 C2 | 3/1994 |
| DE | 196 16 337 A1 | 11/1997 |

* cited by examiner

*Primary Examiner*—Andrew H. Hirshfeld
*Assistant Examiner*—Marvin P. Crenshaw
(74) *Attorney, Agent, or Firm*—Jones, Tullar & Cooper, PC

(57) ABSTRACT

A rubber blanket is provided with reinforcement rails on one or both of its ends. These reinforcement rails are positionable in a narrow channel in a rubber blanket cylinder. The reinforcement rail or rails extend beyond the ends of the channel. Rubber blanket cylinder tensioning devices engage the extending ends of the rubber blanket reinforcement parts.

11 Claims, 1 Drawing Sheet

RUBBER BLANKET AND DEVICE FOR FIXING A RUBBER BLANKET

FIELD OF THE INVENTION

The present invention relates to a rubber blanket and to a device for fastening a rubber blanket on a rubber blanket cylinder of a rotary printing press. The blanket has at least one reinforcement rail at one of its ends. This reinforcement rail extends beyond the width of the blanket and is useable to secure the blanket to a cylinder.

DESCRIPTION OF THE PRIOR ART

A rubber blanket tensing device is known from DE 196 16 337 A1. Each end of the rubber blanket is provided with a suspension rail. Here, a first, or leading, end is brought into a lateral cutout of the cylinder channel, and a second, or trailing, end is radially pulled into the channel by a tensing strip and is tensed in this way.

DE 78 20 773 U1 discloses a rubber blanket with suspension rails. The suspension rails protrude past the width of the rubber blanket.

SUMMARY OF THE INVENTION

The object of the present invention is directed to providing a rubber blanket and a device for fastening a rubber blanket.

In accordance with the present invention, this object is attained by providing the rubber blanket with at least one reinforcement rail at one end. Both blanket ends can have reinforcement rails. These reinforcement rails may have a height that is at least twenty times the thickness of the blanket. The rail or rails have a length greater than the width of the blanket. This length extends past the width of the blanket. The protrusion works with a blanket fastening device.

The advantages which can be achieved by the present invention reside, in particular, in that only a narrow visible tensioning or securement channel is provided, so that a large printing length can be achieved with the rubber blanket cylinder. Neither a tensioning spindle nor a tensioning strip are required for this simply and dependably operating device.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 2:
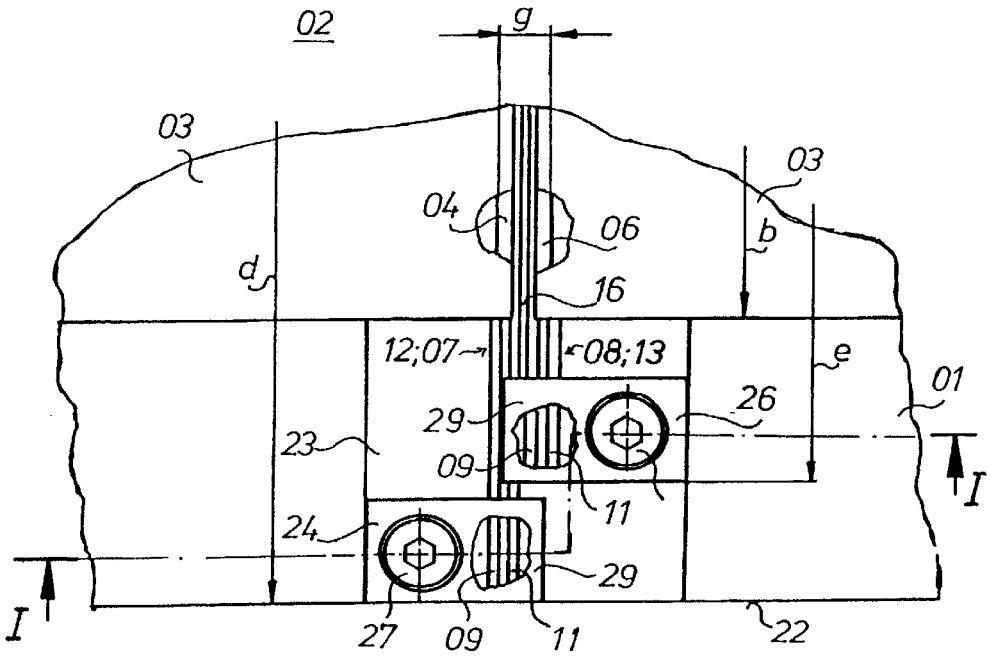

A rubber blanket 03, for example of a thickness "a" of approximately 2 mm and a width "b" of approximately 1000 mm, rests on the surface 01 of a rubber blanket cylinder 02. A first—for example U-shaped—reinforcement rail 07 and a second reinforcement rail 08 are interlockingly attached to or incorporated into the material of the rubber blanket 03 at the first and second ends 04, 06, respectively of the rubber blanket 03. They are sufficiently bending-resistant in respect to their longitudinal axis. Cross-sectional, form and section modulus have been appropriately selected. On the left and on the right ends of the rubber blanket 03, the reinforcement rails 07, 08 each protrude with their first or left ends 12 and their second or right ends 13 laterally past the rubber blanket 03 by at least five millimeters, as seen in FIG. 2. The reinforcement rails 07, 08 are longer than the rubber blanket 03 is wide.

As stated, the first and second ends 04, 06 of the rubber blanket 03 are fastened to the reinforcement rails 07, 08, for example by rivets, or by gluing, vulcanizing, etc. The reinforcement rails 07, 08 can each have a height "f", which height "f" is twenty to forty times the thickness "a" of the rubber blanket 03.

The ends 12, 13 of the reinforcement rails 07, 08, whose edges have been inserted into a cylinder channel 14 formed in the blanket cylinder 02, protrude past the width "b" of the rubber blanket 03, as well as laterally out of the cylinder channel 14, again as seen in FIG. 2.

The ends 04, 06 of the rubber blanket 03, with the part of the reinforcement rails 07, 08 fastened on them, are inserted into the narrow cylinder channel 14, which extends in approximately the radial and axial direction of the rubber blanket cylinder 02. The opening 16 of the channel 14 facing toward the surface 01 of the blanket cylinder 02 is in the form of a gap having an inside width "g". The cylinder channel 14 has been widened trapezoidally in cross section to an inside width "h". A trapezoidal cross-sectional shape of the cylinder channel 14 is advantageous because it is possible, in this way, to position the reinforcement rails 07, 08 away from each other in the interior of the cylinder channel 14.

The width "g" of the surface opening 16 of the channel 14 can be kept very narrow. It approximately corresponds to the thickness "a" of the rubber blanket 03, plus the thickness "c" of a reinforcement rail 07, plus a small added amount.

Figure 1:
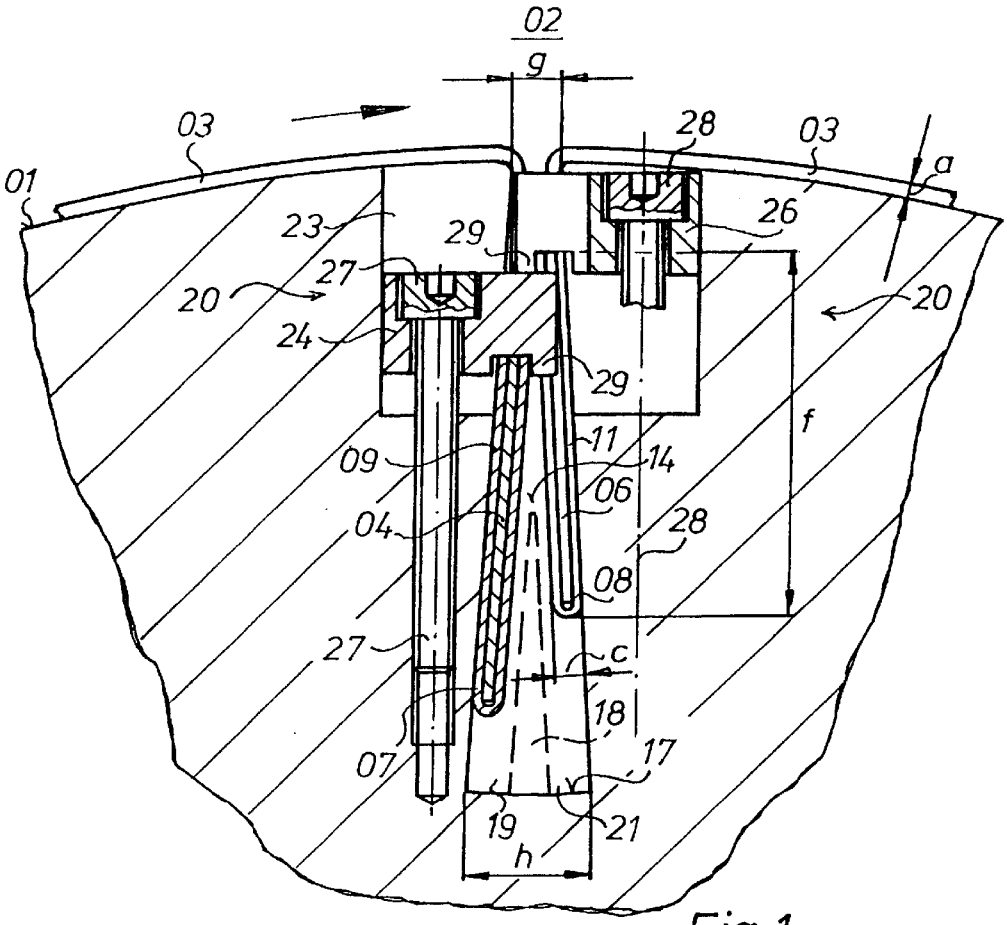
FIG. 1, a partial cross section view through a cylinder with the device of the invention and taken along the section line I—I of FIG. 2, and in FIG. 2, a top plan view on the end of a cylinder with the device corresponding to the representation in FIG. 1.

The cylinder channel 14 can be longitudinally divided into two compartments 19, 21 by a guide strip 18, as represented in dashed lines in FIG. 1, which guide strip 18 is fastened on the channel bottom 17, extends upward and is wedge-shaped. Because of this guide strip 18, it becomes possible for each end 04, 06 of the rubber blanket 03 to be guided into its own compartment 19, 21. In the course of this, the reinforcement rails 07, 08 are conducted away from each other.

A device 20 for generating a pressure force on the free ends 12 and 13 of the reinforcement rails 07, 08 is provided to the left and right on the blanket cylinder 02 next to the start and end of the cylinder channel 14. Device 20 is situated, with respect to the free ends of the reinforcement rails 07, 08 directly next to them or distanced from them. The device 20 is supported on the rubber blanket cylinder body and generates a pressure force on the free ends 12 and 13 of the reinforcement rails 07, 08 acting in the radial direction; i.e. in the direction toward the axis of rotation of the rubber blanket cylinder 02 and in this way holds and tensions the rubber blanket 03.

Devices 20 for generating a pressure force are provided for each free end 12, 13 of the reinforcement rails 07, 08. They comprise, for example, respective tensioning blocks 24, 26, each of which can be moved in the direction toward or away from the axis of rotation of the cylinder, or radially up and down, by a releasable interlocking connection, for example respective screws 27, 28, at the side of the cylinder channel 14 of the rubber blanket cylinder 02, and in this way can exert pressure force on the free ends 12, 13 of the reinforcement rails 07, 08.

Each tensioning block 24,26 fixed against relative rotation, and for example each has a projection 29 extending around and resting against the free ends 12, 13 of the reinforcement rails 07, or 08, as shown most clearly in FIG. 1.

In the radial direction of the blanket cylinder 02, the tensioning blocks 24, 26 also have distances of different length from the surface 01 of the rubber blanket cylinder 02, as seen in FIG. 1. Thus, both tensioning blocks 24 of the first or leading end 04 of the rubber blanket 03 are farther distanced from the surface 01 than the tensioning blocks 26 of the second or trailing end 06 of the rubber blanket 03.

The devices 20 are each fastened in a cutout 23 on the barrel of the rubber blanket cylinder 02. One wall of this cutout 23 can be used as a torsion guard. However, the devices 20 can also be fastened on both front faces 22 of the rubber blanket barrels.

While a preferred embodiment of a rubber blanket and of a device for fixing a rubber blanket to a blanket cylinder in accordance with the present invention have been set forth fully and completely hereinabove, it will be apparent to one of skill in the art that various changes in, for example, the overall size of the cylinder, the drive for the cylinder and the like could be made without departing from the true spirit and scope of the present invention which is accordingly to be limited only by the following claims.

What is claimed is:

1. A rubber blanket comprising:

a first blanket end and a second blanket end;

a first reinforcement rail on said first blanket end and a second reinforcement rail on said second blanket end, said first reinforcement rail having a first length and said second reinforcement rail having a second length, said first and second lengths being different from each other;

a width defined by each of said first blanket end and said second blanket end, said first and second lengths both being greater than said width, said first and said second reinforcement rails protruding beyond the rubber blanket at different lengths.

2. The rubber blanket of claim 1 wherein each of said first and second reinforcement rails protrude past said rubber blanket by at least five millimeters.

3. A device adapted to fasten a rubber blanket to a rubber blanket cylinder comprising:

a first reinforcement rail on at least one end of the rubber blanket, at least a first end of said first reinforcement rail extending beyond a width of the rubber blanket;

reinforcement rail end engagement devices on the blanket cylinder;

a cylinder channel in said rubber blanket cylinder and having a channel bottom; and a strip of wedge-shaped cross-section in said cylinder channel and secured to said cylinder bottom.

4. The device of claim 3 wherein said device includes a tensioning block movably supported on said rubber blanket cylinder by screws.

5. The device of claim 3 wherein said cylinder channel in said rubber blanket cylinder is trapezoidally shaped, said cylinder channel widening toward a radially inwardly located channel bottom.

6. The device of claim 3 further including first and second ends of said first reinforcement rail, and a separate one of said reinforcement rail end engagement devices for each of said first and second ends of said first reinforcement rail.

7. The device of claim 3 further including a second reinforcement rail on a second end of the rubber blanket and further including separate ones of said reinforcement rail end engagement devices for each of said first and second reinforcement rails.

8. The device of claim 7 wherein said first reinforcement rail end engagement device and said second reinforcement rail end engagement device are axially offset on said rubber blanket cylinder with respect to each other.

9. The device of claim 7 wherein said first reinforcement rail end engagement device and said second reinforcement rail end engagement device are radially circumferentially offset on said rubber blanket cylinder with support to each other.

10. A device adapted to fasten a rubber blanket to a rubber blanket cylinder comprising:

a first reinforcement rail on at least one end of the rubber blanket, at least a first end of said first reinforcement rail extending beyond a width of rubber blanket; and reinforcement rail end engagement devices on the blanket cylinder, each of said reinforcement rail end engagement devices including a tensioning block movably supported on said rubber blanket cylinder by screws, each said tensioning block having a torsion guard.

11. A device adapted to fasten a rubber blanket to a rubber blanket cylinder comprising:

a first reinforcement rail on a first end of the rubber blanket, at least a first end of said first reinforcement rail extending beyond a width of the rubber blanket;

a second reinforcement rail on a second end of the rubber blanket;

a first reinforcement rail end engagement device for said first reinforcement rail on said rubber blanket cylinder; and a second reinforcement rail end engagement device for said second reinforcement rail on said rubber blanket cylinder, said first and second reinforcement rail end engagement devices being axially offset on said rubber blanket cylinder with respect to each other.

* * * * *